US007364498B1

(12) United States Patent
Snyder

(10) Patent No.: US 7,364,498 B1
(45) Date of Patent: Apr. 29, 2008

(54) DOUBLE ARMED FINISHING TOOL FOR TUBING MATERIALS

(75) Inventor: Terence L. Snyder, Lancaster, PA (US)

(73) Assignee: G. G. Schimtt & Sons, Inc., Lancaster, PA (US)

( * ) Notice: Subject to any disclaimer, the term of this patent is extended or adjusted under 35 U.S.C. 154(b) by 52 days.

(21) Appl. No.: 11/412,663

(22) Filed: Apr. 27, 2006

Related U.S. Application Data

(60) Provisional application No. 60/676,084, filed on Apr. 29, 2005.

(51) Int. Cl.
*B24B 21/00* (2006.01)

(52) U.S. Cl. ..... 451/296; 451/302; 451/311; 451/355

(58) Field of Classification Search ..... 451/49, 451/51, 296, 302, 310, 311, 355, 513
See application file for complete search history.

(56) References Cited

U.S. PATENT DOCUMENTS

| | | | | |
|---|---|---|---|---|
| 3,566,549 A | | 3/1971 | Britton | 51/170 |
| 4,368,597 A | | 1/1983 | Fleckenstein | 51/170 |
| 4,411,106 A | | 10/1983 | Fleckenstein | 51/170 |
| 4,754,579 A | | 7/1988 | Batt | 51/170 |
| 4,858,390 A | | 8/1989 | Kenig | 51/135 R |
| 5,031,362 A | | 7/1991 | Reiling | 51/170 R |
| 5,628,678 A | * | 5/1997 | Tridico | 451/296 |
| 6,220,946 B1 | * | 4/2001 | Arnold | 451/307 |
| 6,648,737 B2 | * | 11/2003 | Deware et al. | 451/59 |
| 2003/0003854 A1 | * | 1/2003 | Deware et al. | 451/59 |

* cited by examiner

*Primary Examiner*—Eileen P. Morgan
(74) *Attorney, Agent, or Firm*—Miller Law Group, PLLC

(57) ABSTRACT

A belt grinding finishing tool incorporates a pair of mounting arms projecting forwardly from a drive housing to support a single abrasive belt entrained around drive and idler pulleys. The first mounting arm is positionally fixed relative to the drive housing, but the second mounting arm is pivotally mounted to permit relative pivotal movement thereof. The dual mounting arm configuration enables a tubular member to be placed between the mounting arms to effect a finishing of opposing sides of the outer surface of the tubular member simultaneously. A support housing detachably mounted on the drive housing includes a support handle that can be selectively connected to alternative attachments mounts formed on the support housing. An actuation lever extending outwardly from the second mounting arm permits the operator to cause pivotal movement of the pivoted second mounting arm to accept the tubular member to be finished between the mounting arms.

20 Claims, 8 Drawing Sheets

DOUBLE ARMED FINISHING TOOL FOR TUBING MATERIALS

CROSS-REFERENCE TO RELATED APPLICATIONS

This application claims domestic priority on U.S. Provisional Patent Application Ser. No. 60/676,084, filed Apr. 29, 2005, the contents of which are incorporated herein by reference.

BACKGROUND OF THE INVENTION

The present invention relates generally to a hand tool for finishing tubing materials and, more particularly, to a manually manipulated belt grinder or abrading tool that is operable to finish opposing sides of a tubing member simultaneously.

Manually manipulated miniature belt grinders are used within small cavities or restricted openings in sheet metal, castings, forgings and the like for deburring and finishing operations. The miniature belt grinders are typically constructed with an endless belt having an outer abrasive surface trained about a drive pulley and a contact pulley. The endless belt corresponds to an outwardly extending arm so that the metallic material to be finished can be engaged with either side of the abrasive belt. A pneumatic motor typically provides the operative power for rotating the abrasive belt so that the tool can be driven through manipulation of a hand control while the rotated belt is pressed against the metallic surface to be finished. Conventionally, the pneumatic motors used to drive the belt grinders are suitably fixed to the casing of the grinder such that they provide a convenient grinder manipulating handle with the drive shaft thereof extending into the casing and serving to support and effect driven rotating of the drive pulley about which one end of the abrasive belt is entrained.

One such miniature belt grinding tool can be found in U.S. Pat. No. 4,368,597, issued to Elwin H. Fleckenstein, et al on Jan. 18, 1983, and in U.S. Pat. No. 4,411,106, issued to Elwin H. Fleckenstein on Oct. 25, 1983. The Fleckenstein grinding tool is pneumatically driven and is formed with a single arm on which is mounted a drive pulley and a tensioning idler pulley with the abrasive belt being entrained around the pulleys to be engagable with the metallic surface to effect a finishing thereof. Similar tools are taught in U.S. Pat. No. 4,754,579, issued to Dennis M. Batt on Jul. 5, 1988, in which a dust collection apparatus is associated with the rotating abrasive belt to minimize the dispersal of dust during the operation of the portable hand-held implement. Such grinding devices are also constructed in a configuration that is adapted for attachment to a rotary power tool, as is shown in U.S. Pat. No. 4,858,390, issued to Nisan Kenig on Aug. 22, 1989, and in U.S. Pat. No. 5,031,362, issued to Reinhold Reiling on Jul. 16, 1991. As with the pneumatically power miniature grinding tools, the abrasive belt is entrained around drive and tensioning pulleys mounted on a single outwardly extending arm.

The abrasive belt can also be mounted in a triangular configuration to facilitate utilization thereof against a cylindrical tubing member by entraining the abrasive belt around three pulleys, one drive pulley and a pair of spaced apart idler pulleys between which the tubular object to be finished can be positioned so that the abrasive belt can form around the cylindrical surface of the tubing member for enhanced engagement thereof. As is depicted in U.S. Pat. No. 3,566,549, issued to James A. Britton on Mar. 2, 1971, and in U.S. Pat. No. 5,628,678, issued to Frank Tridico on May 13, 1997, the second idler pulley can be mounted on a second mounting arm that is spring-loaded away from the main housing of the tool. When the abrasive belt is placed into engagement with a tubular member to effect a finishing operation thereon, the second arm yields against the biasing apparatus to permit the abrasive belt to partially wrap around the surface of the tubing member. While up to about half of the cylindrical surface of the tubing member can be finished, the tool would have to be oriented in an opposing direction in order to finish the opposing half of the tubing member.

Accordingly, it would be desirable to provide a hand grinder apparatus that would be operable to finish opposing sides of a tubing member simultaneously so that the finishing operation for a tubing member can be accomplished more quickly than with the belt grinder devices known in the art.

SUMMARY OF THE INVENTION

It is an object of this invention to overcome the disadvantages of the prior art by providing a double-armed finishing tool for smoothing opposing sides of a tubular member simultaneously.

It is a feature of this invention that the finishing tool is a belt grinding apparatus having a pair of outwardly extending mounting arms about which an abrasive belt is entrained to provide an abrading surface engagable with opposing sides of a tubular member placed between the mounting arms.

It is an advantage of this invention that the tubular member can be finished quickly by smoothing opposing sides thereof simultaneously.

It is another object of this invention to provide a belt grinding finishing apparatus that is operable to smooth opposing sides of a tubular member simultaneously.

It is another feature of this invention that one of the mounting arms is pivotally supported on the drive housing for movement about a pivot pulley relative to the other mounting arm.

It is another advantage of this invention that the pivoted mounting arm can be positioned to allow a tubular member to be positioned between the mounting arms.

It is yet another feature of this invention that an actuation lever projects outwardly from the second mounting arm to permit the grasping of the actuation lever for opening the gap between the distal tips of the mounting arms.

It is still another feature of this invention that the first mounting arm incorporates a belt tensioning mechanism that biases the idler pulley at the distal tip of the first mounting arm away from the drive pulley.

It is still another advantage of this invention that the belt tensioning mechanism allows the second mounting arm to be pivoted away from the first mounting arm by drawing the idler pulley on the first mounting arm toward the drive pulley.

It is yet another advantage of this invention that the belt tensioning mechanism is operable to pivot the second mounting arm toward the first mounting arm, minimizing the distance between the respective distal tips of the mounting arms.

It is yet another feature of this invention that the second mounting is operably associated with a stop member to limit the pivotal movement of the second mounting arm toward the first mounting arm to prevent interference therebetween.

It is a still another object of this invention to provide a drive housing for a belt grinding tool in which a single abrasive belt can be entrained between a pair of mounting arms so that opposing sides of a tubular member can be finished simultaneously with the same abrasive belt.

It is a further feature of this invention that a pair of fixed pulleys rotatably mounted on the drive housing enables the entrainment of a single abrasive belt to be operable simultaneously along a pair of mounting arms.

It is still a further feature of this invention that a support housing detachably mounted on the drive housing has a support handle connected thereto to facilitate the positioning of the finishing tool.

It is a further advantage of this invention that the support handle is selectively connected to alternate attachment mounts to provide selectively alternative positioning of the support handle.

It is yet another object of this invention to provide a double-armed belt grinding tool for use in finishing structural members in which the grinding tool is durable in construction, inexpensive of manufacture, carefree of maintenance, facile in assemblage, and simple and effective in use.

These and other objects, features and advantages are accomplished according to the instant invention by providing a belt grinding tool incorporating a pair of mounting arms projecting forwardly from a drive housing to support a single abrasive belt entrained around drive and idler pulleys. The first mounting arm is positionally fixed relative to the drive housing, but the second mounting arm is pivotally mounted to permit relative pivotal movement thereof. The dual mounting arm configuration enables a tubular member to be placed between the mounting arms to effect a finishing of opposing sides of the outer surface of the tubular member simultaneously. A support housing detachably mounted on the drive housing includes a support handle that can be selectively connected to alternative attachments mounts formed on the support housing. An actuation lever extending outwardly from the second mounting arm permits the operator to cause pivotal movement of the pivoted second mounting arm to accept the tubular member to be finished between the mounting arms.

BRIEF DESCRIPTION OF THE DRAWINGS

The foregoing and other objects, features, and advantages of the invention will appear more fully hereinafter from a consideration of the detailed description that follows, in conjunction with the accompanying sheets of drawings. It is to be expressly understood, however, that the drawings are for illustrative purposes and are not to be construed as defining the limits of the invention.

DETAILED DESCRIPTION OF THE PREFERRED EMBODIMENT

Figure 1:
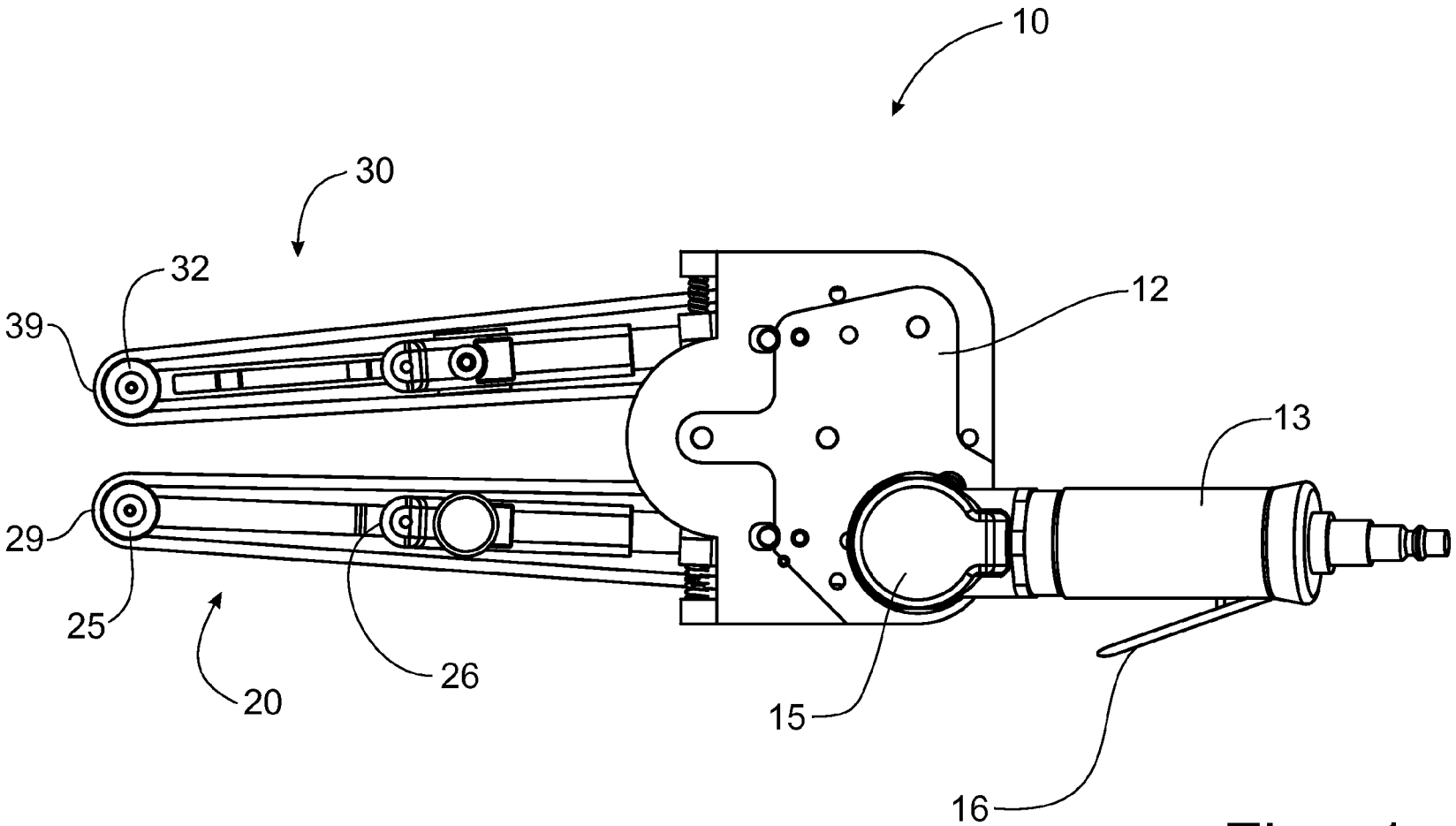
FIG. 1 is a top plan view of a belt grinder apparatus incorporating the principles of the instant invention, the support handle and associated housing being positioned for operation.

Referring to FIGS. 1-8, a belt grinder apparatus 10 incorporating the principles of the instant invention can best be seen. The belt grinder apparatus 10 is constructed with a drive housing 12, best seen in FIG. 3, having a drive motor 15 affixed thereto. The drive motor 15 can be operatively driven in a number of different ways, such as hydraulically or electrically, or from a rotary tool, but is preferably driven by a pneumatic source of pressurized air. Accordingly, the drive housing 12 has a control handle 13 affixed thereto to serve as a connector via the attachment nipple 14 to a remote source of pressurized air. The control lever 16 is associated with a valve that controls the influx of pressurized air into the pneumatic motor 15 to effect a rotational driving operation thereof. As the control lever 16 is closed toward its outwardly extending position shown in FIGS. 1 and 3 against the control handle 13, air is allowed to pass through the control handle 13 into the pneumatic motor 15. Air is exhausted from the motor 15 in a conventional manner.

Figure 2:
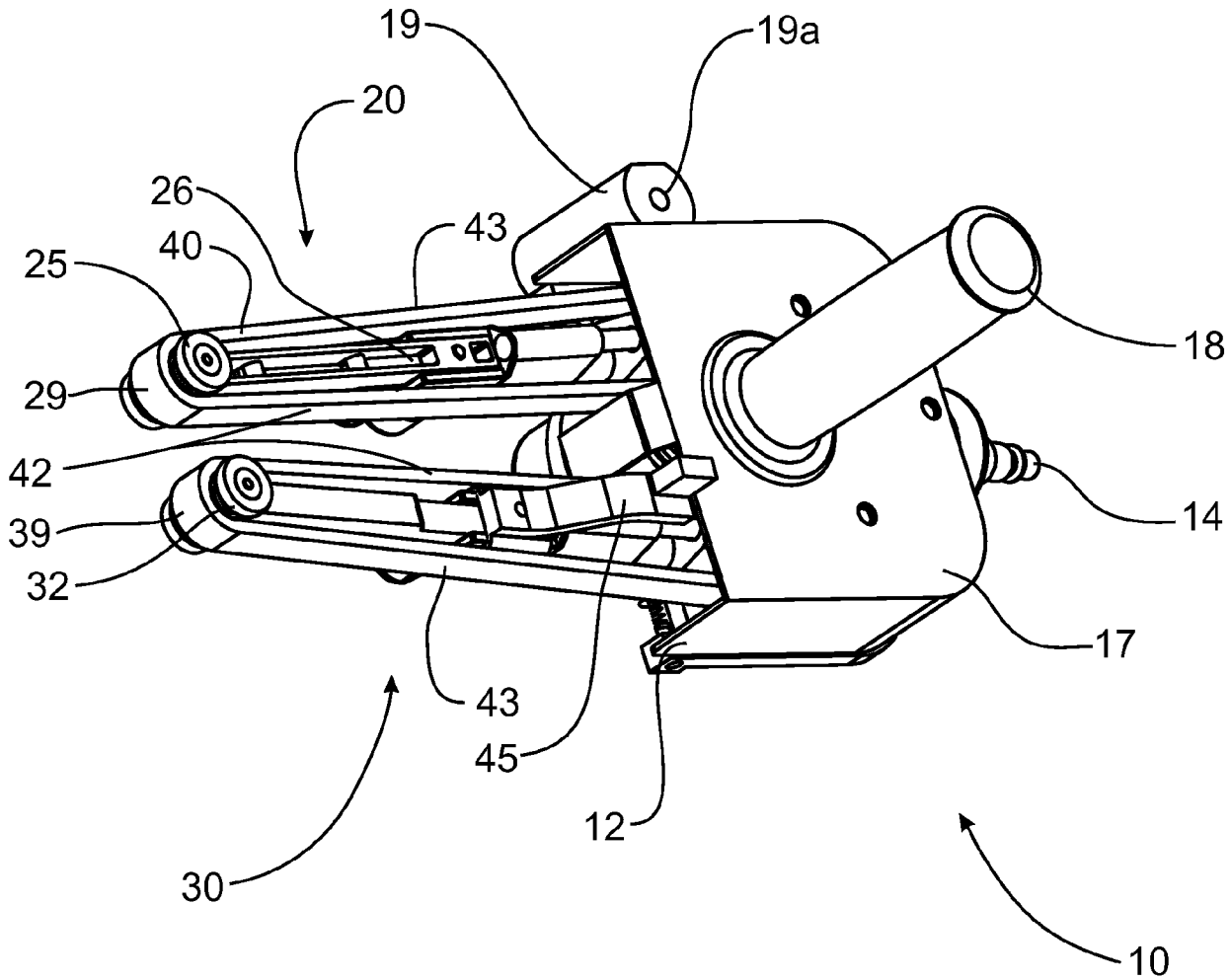
FIG. 2 is a bottom, front perspective view of the belt grinder apparatus depicted in FIG. 1.
Figure 3:
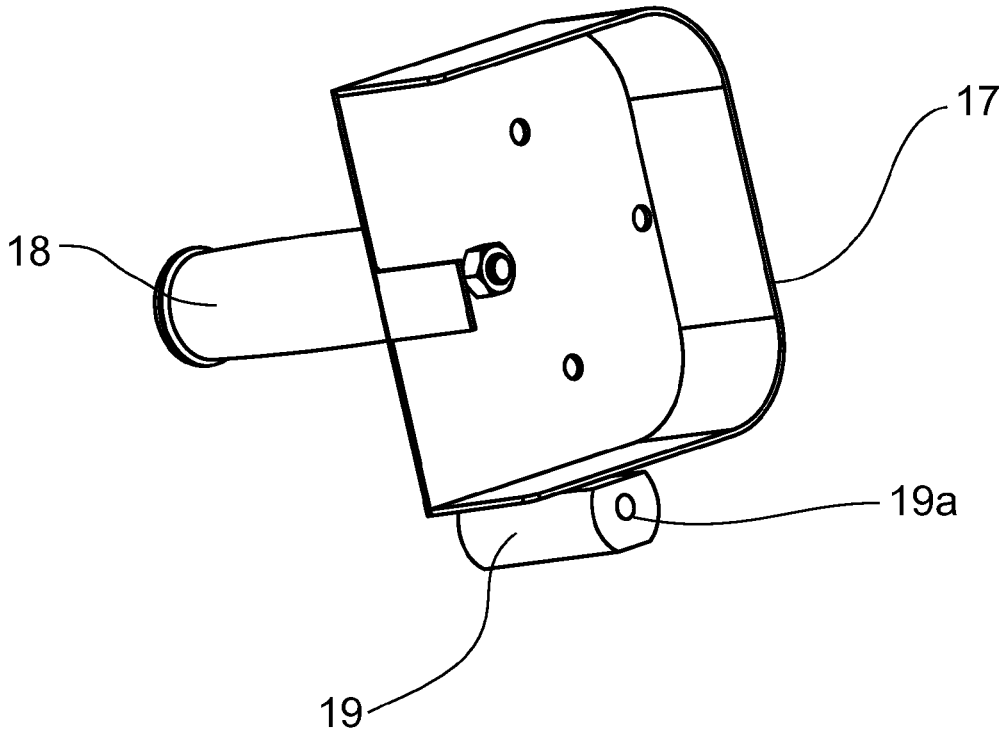
FIG. 3 is a perspective view of the support housing depicted in FIG. 2.

Opposite the drive housing 12 is a detachable support housing 17, shown in FIGS. 2 and 3, which has a support handle 18 mounted thereto. The support housing 17 covers the otherwise open drive housing 12 and allows the support handle 18 to be utilized to help support the weight of the tool 10 during operation, with the belt grinder tool 10 being supported through use of the control handle 13 and the support handle 17. Preferably, the support housing 17 is formed with supplemental handle mount 19 that is positioned to one side of the support housing 17 and is adapted for the mounting of the support handle 18. Accordingly, the support handle 17 can be selectively mounted at the convenience and comfort of the operator from a generally central position on the support housing 17 to an offset position corresponding to the alternative handle mount 19.

Referring now to FIGS. 1, 2 and 5-7, the belt grinder apparatus 10 is constructed with a pair of generally parallel oriented mounting arms 20, 30 projecting outwardly from the drive housing 12 generally perpendicularly to the orientation of the support handle 18. Each of the mounting arms 20, 30 supports a run of the abrading belt 40 with an interior side 42 and an exterior side 43. By positioning the double armed grinding tool 10 with a tubular member T to be finished between the mounting arms 20, 30, the respective interior runs 42 can engage and finish opposite sides of a tubing member simultaneously. Either of the exterior sides 43 corresponding to the mounting arms 20, 30 can also be used to finish a metallic member in substantially the same manner as is known in the art, i.e. by engaging only one side of the member being finished.

The abrasive belt 40 is preferably an endless member that is entrained and driven for rotational operation relative to the mounting arms 20, 30. The drive housing 12 supports a drive pulley 22 operatively associated with the pneumatic motor 15 to be rotatably driven when the control lever 16 is depressed to direct pressurized air into the motor 15. The abrasive belt 40 extends from the drive pulley 22 around the tensioning pulley 25 mounted at the end of the first mounting arm 20, then around a first fixed idler pulley 27 mounted on the drive housing 12, then around the idler pulley 32 at the end of the second mounting arm 30, then around a pivot pulley 35 connected to the inner end of the second mounting arm 30, then around a second fixed idler pulley 37 mounted on the drive housing 12 and finally back around the drive pulley 22. Thus, the abrasive belt 40 is entrained in serpentine path that wraps around the drive pulley 22, the tensioning pulley 25, the first fixed idler pulley 27, the idler pulley 32, the pivot pulley 35, and the second fixed idler pulley 37. Preferably, the drive pulley 22 is formed with a surface coating that enhances the frictional driving connection between the drive pulley 22 and the interior surface of the belt 40.

The first mounting arm 20 includes a spring-loaded tensioning mechanism 26 that is connected to the tensioning idler 25 at the end of the first mounting arm 20. The tensioning idler 25 is movable along the longitudinal main axis of the first mounting arm 20 toward and away from the drive pulley 22. The movement of the tensioning idler 25 keeps a desired level of tension in the abrasive belt 40 for proper engagement with the member T to be finished by the engagement thereof with the abrasive belt. The idler 32 at the distal end of the second mounting arm 30 can be fixed in relation to the corresponding pivot pulley 35 at the inner end of the second mounting arm 30 because any deflection of the abrasive belt 40 associated with the second mounting arm 30 can be accommodated by the movement of the tensioning idler 25.

The second mounting arm 30 is preferably pivotally mounted to the drive housing 12 concentric with the rotational axis of the pivot pulley 35. Since the second mounting arm 30 pivots about the center of the pivot pulley 35, the pivotal movement of the second mounting arm 30 relative to the first mounting arm 20 results in a corresponding tensioning movement of the tensioning idler 25. Since the pivotal movement of the second mounting arm 30 covers only a few degrees, the amount of movement of the tensioning idler 25 is not substantial. The pivotal movement of the second mounting arm 30 allows the distal tips 29, 39 of the mounting arms 20, 30 to have an increased spacing to accept the passage of a tubular member T to be finished between the mounting arms 20, 30 by the interior runs 42 of the abrasive belt 40.

An actuation lever 45 is affixed to the second mounting arm 30 and projects outwardly therefrom away from the rotating abrasive belt 40 to permit the operator to selectively pivot the second mounting arm 30 away from the first mounting arm 20 to increase the distance between the distal tips 29, 39 of the mounting arms 20, 30. The tension in the abrasive belt 40 exerted by the tensioning mechanism 26 pulls the second mounting arm 30 toward the first mounting arm 20, while a stop member (not shown) limits the inward pivoting of the second mounting arm 30 to prevent the distal tips 29, 39 from engaging. One skilled in the art will recognize that both the first mounting arm 20 and the second mounting arm 30 could be pivotally mounted; however, the best operative results were found when the first mounting arm 20 was fixed in relationship to the drive housing 12 while the second mounting arm 30 was pivotally mounted.

In operation, the double-armed belt grinder 10 is positioned at the tubular member T to be finished. By grasping the actuation lever 45 and pivoting the second mounting arm 30 outwardly away from the first mounting arm 20, the distance between the distal tips 29, 39 of the mounting arms 20, 30 can be increased adequately to permit the passage of the tubular member T to pass between the tips 29, 39 to be engaged by both of the interior runs 42 of the abrasive belt 40. The tension exerted by the tensioning mechanism 26 into the abrasive belt 40 through the tensioning pulley 25 draws the second mounting arm 30 inwardly toward the first mounting arm 20 to effect engagement of the tubular member T on substantially opposite sides thereof. Thus, opposing sides of the tubular member T can be finished simultaneously.

Depressing the control lever 16 on the control handle 13, pressurized air is directed through the control handle 13 into the pneumatic motor 15 to power the rotation of the drive pulley 22 to drive the rotation of the endless abrasive belt 40. The entire circumference of the tubular member T can be finished by simply rotating the belt grinder tool 10 about the tubular member T through a displacement of approximately ninety degrees. With conventional single arm miniature belt grinding tools, finishing the entire circumference of a tubular member T would require at least one hundred eighty degrees of movement of the belt grinder tool 10 relative to the tubular member T, assuming that both opposing sides of the abrasive belt would be utilized. Accordingly, the double-armed belt finishing tool 10 incorporating the principles of the instant invention reduces the operation time required to finish a tubular member T.

Replacement of the abrasive belt 40 is accomplished by releasing the tension from the tensioning mechanism 26 to permit the tensioning pulley 25 to be retracted along the first mounting arm 20 toward the drive pulley 22. The abrasive belt can then be removed easily from the mounting arms and pulleys. The entrainment of a replacement abrasive belt 40 and the re-engagement of the tensioning mechanism 26 readies the tool 10 for operation.

Since the exterior runs 43 corresponding to the first and second mounting arms 20, 30 proximate the opposing sides of a conventional single armed miniature belt grinder tool, the double armed belt grinder tool 10 incorporating the principles of the instant invention can also be utilized in a conventional manner by engaging the metallic member to be finished with one of the exterior runs 43.

Figure 4:
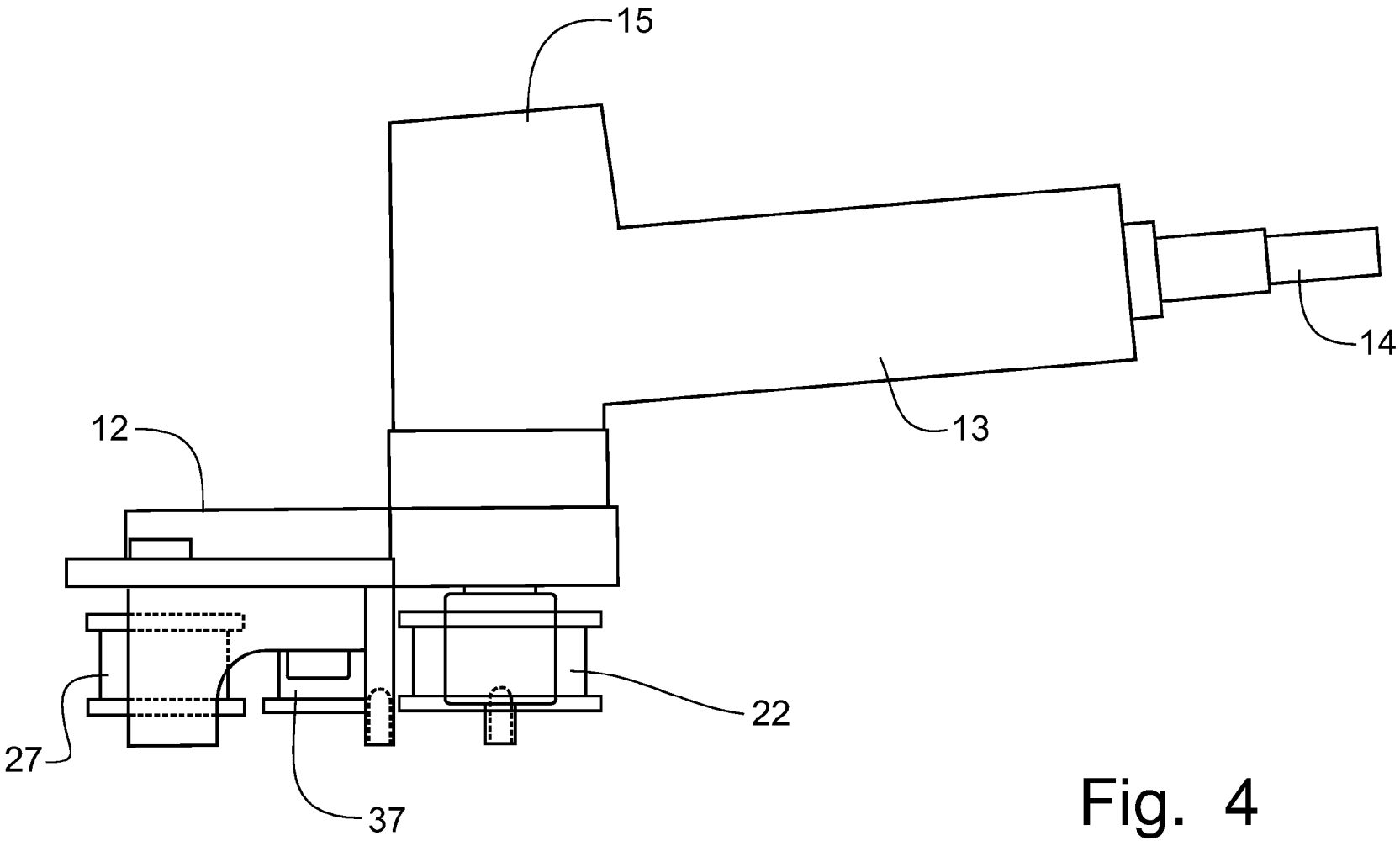
FIG. 4 is a side elevational view of the grinder apparatus with the forwardly extending arms removed for purposes of clarity.
Figure 5:
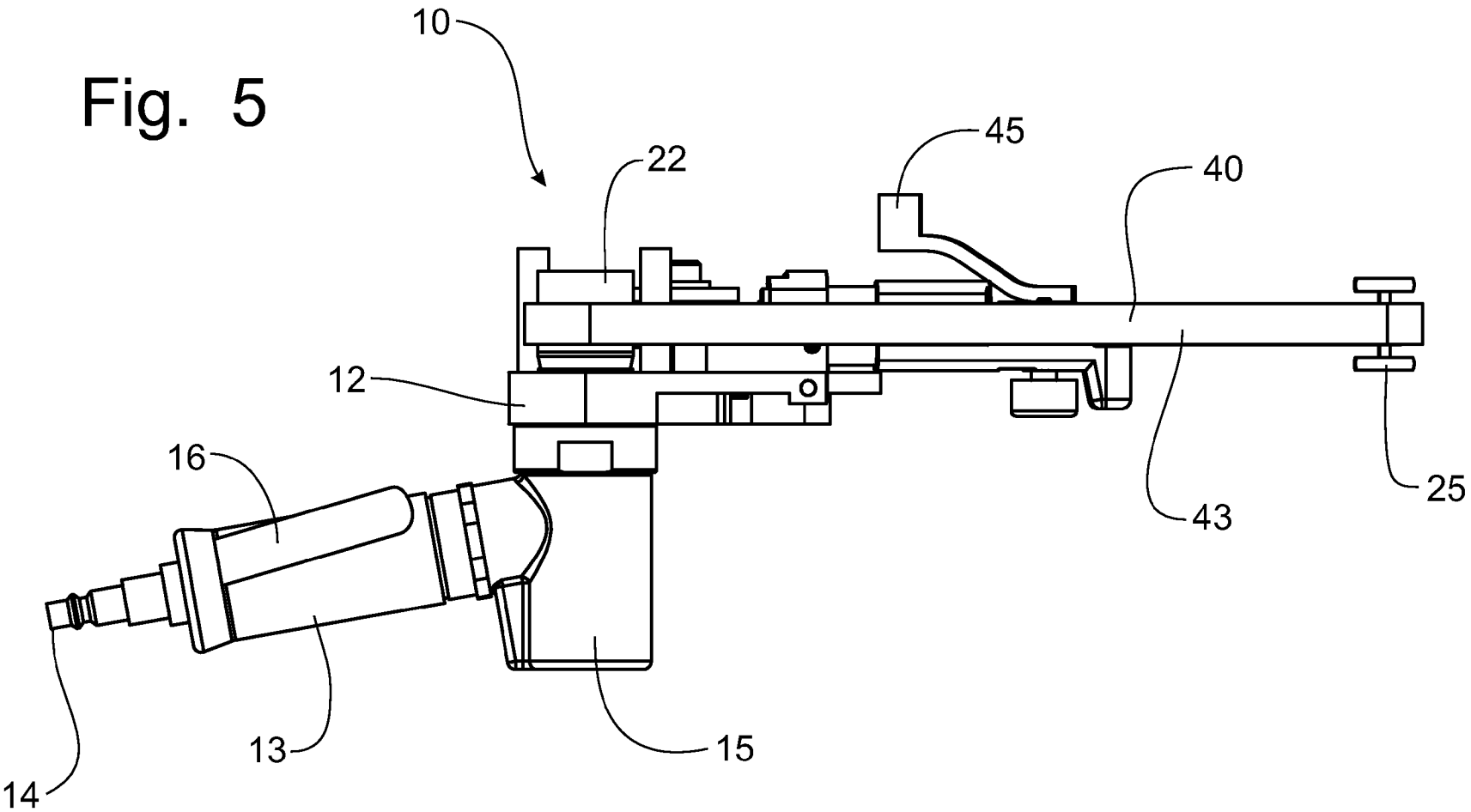
FIG. 5 is a side elevational view of the grinding apparatus with the support housing removed to depict the grinding belt.
Figure 6:
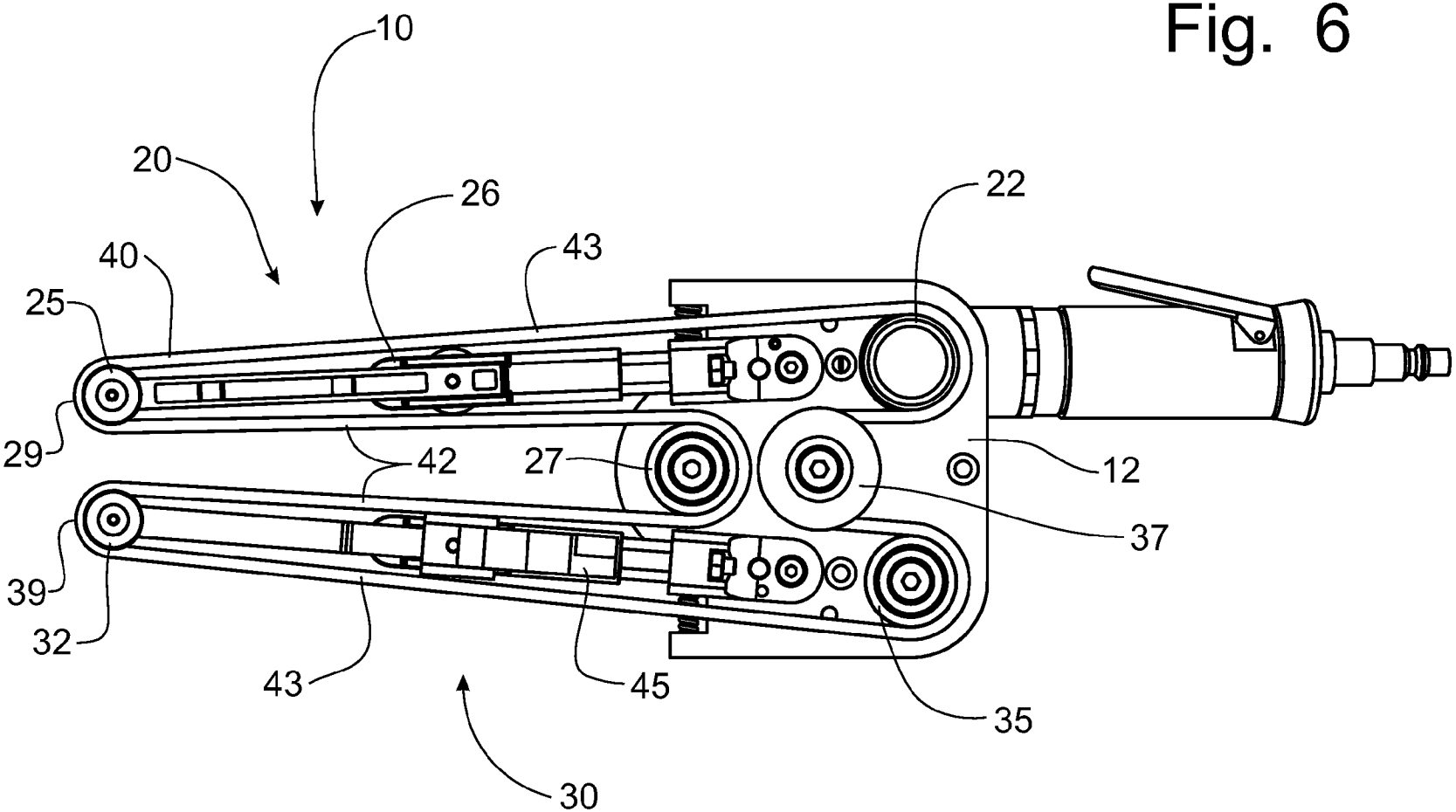
FIG. 6 is a bottom plan view of the belt grinder apparatus with the support housing removed to better view the entrainment of the abrasive belt and the orientation of the mounting arms relative to the drive housing of the belt grinder apparatus.
Figure 7:
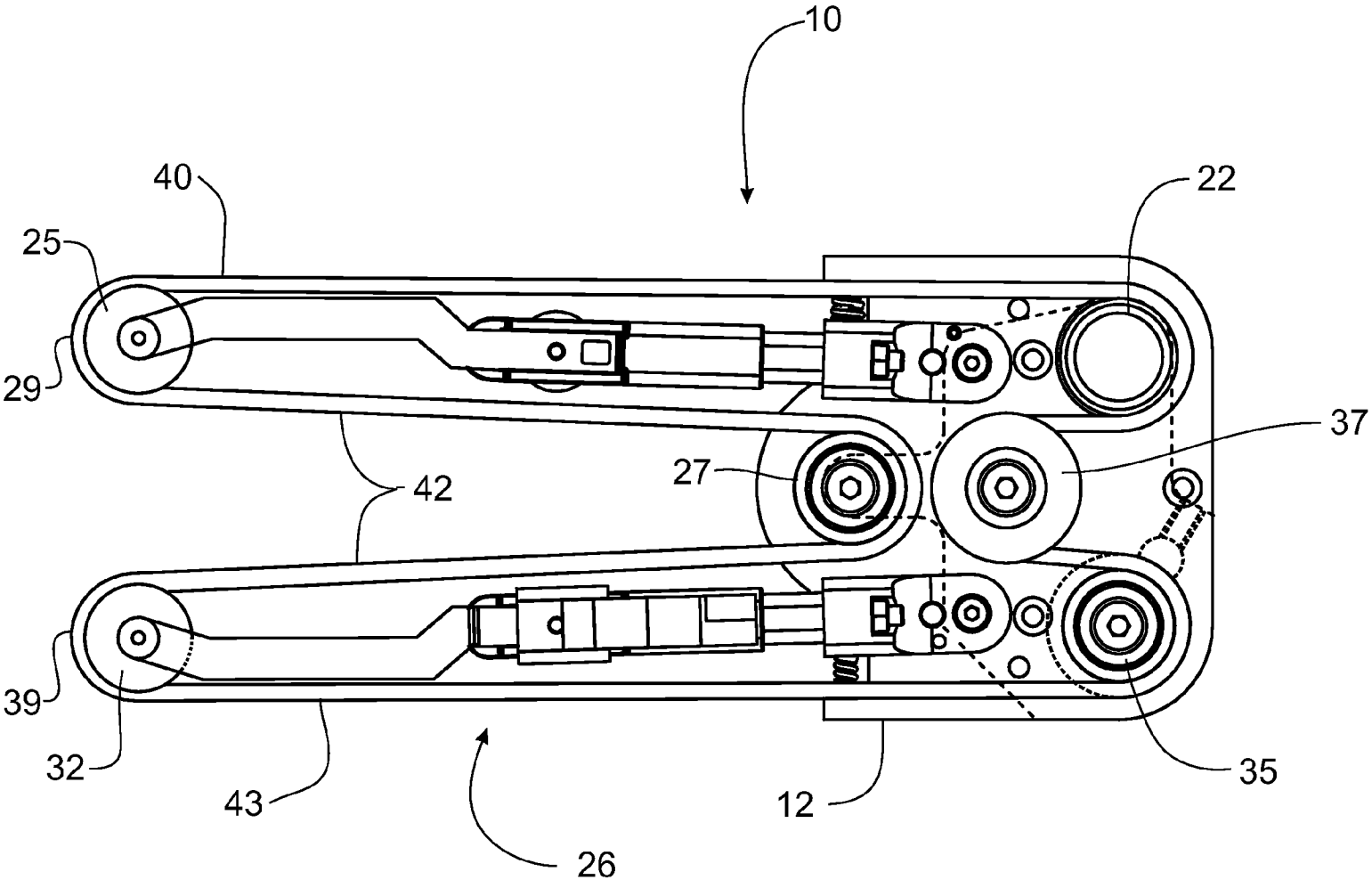
FIG. 7 is a bottom plan view of the body and arm portions of the belt grinder apparatus as depicted in FIG. 6 with the support housing removed.
Figure 8:
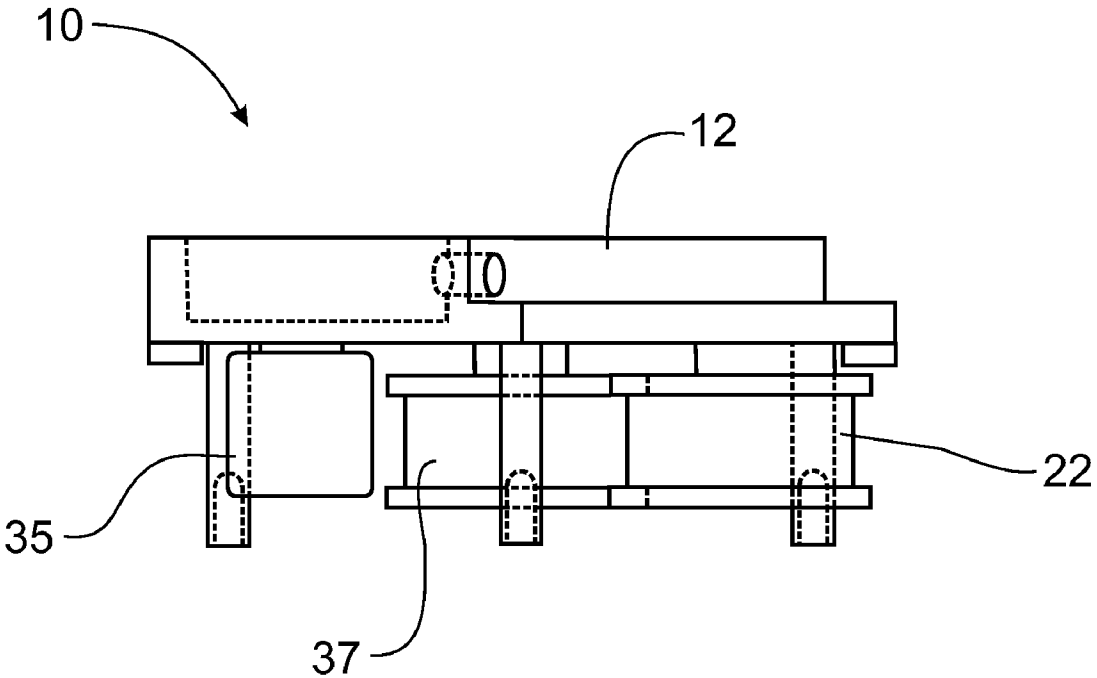
FIG. 8 is a rear elevational view of the body portion of the belt grinder apparatus with the support housing removed therefrom.

Depending on the angle of deployment of the member to be finished and the discretionary comfort of the operator, the support handle 18 can be positioned at the central location on the support housing 17, as is shown in FIGS. 1, 2 and 4, or disconnected and then re-mounted on the alternative mount 19 to locate the support handle 18 in an offset orientation with respect to the support housing 17. As can be seen in FIGS. 2 and 3, the alternative mount 19 can be provided with a threaded bore 19*a* accessible from either side of the alternative mount 19 to permit a selective attachment of the support handle 18 in opposing orientations for the comfort of the operator. A third bore opening (not shown) formed in the side of the alternative mount 19 would enable the support handle 18 to be perpendicularly to that shown in FIGS. 2 and 3.

The invention of this application has been described above both generically and with regard to specific embodiments. Although the invention has been set forth in what is believed to be the preferred embodiments, a wide variety of alternatives known to those of skill in the art can be selected within the generic disclosure.

Having thus described the invention, what is claimed is:

1. A belt grinding apparatus comprising:

a drive housing connectable to a source of rotational power and rotatably supporting first and second fixed pulleys;

a first mounting arm supported on said drive housing and including a drive pulley rotatably driven by said source of rotational power and a first idler pulley spaced from said drive pulley;

a second mounting arm supported on said drive housing and including a pivot pulley and a second idler pulley spaced from said pivot pulley; and an abrasive belt entrained around said drive pulley, said first and second fixed pulleys, said pivot pulley and said first and second idler pulleys to define an endless path of rotation that extends along said first and second mounting arms to abrade tubular material positioned between said first and second mounting arms.

2. The belt grinding apparatus of claim 1 wherein said second mounting arm is pivotally mounted for movement about a pivot axis corresponding to an axis of rotation of said pivot pulley to enable said second mounting arm to move relative to said first mounting arm.

3. The belt grinding apparatus of claim 2 wherein said first mounting arm is positionally fixed on said drive housing.

4. The belt grinding apparatus of claim 2 wherein said first and second idler pulleys are positioned at a distal tip of said first and second mounting arms, respectively.

5. The belt grinding apparatus of claim 4 wherein said first mounting arm supports a belt tensioning mechanism operably connected to said first idler pulley for movement along said first mounting arm, said belt tensioning mechanism including a spring biasing said first idler pulley away from said drive pulley.

6. The belt grinding apparatus of claim 5 wherein said second mounting arm includes an actuation lever projecting outwardly therefrom and operable to control the pivoted position of said second mounting arm relative to said first mounting arm.

7. The belt grinding apparatus of claim 6 further comprising a support housing detachably mounted on said drive housing, said support housing including a support handle projecting outwardly therefrom.

8. The belt grinding apparatus of claim 7 wherein said support handle is detachable from said support housing, said support housing providing alternative attachment mounts for connecting said support handle thereto.

9. In a grinding apparatus having a drive housing connectable to a source of rotational power, a first mounting arm supported on said drive housing and including a drive pulley rotatably driven by said source of rotational power and a first idler pulley spaced from said drive pulley, and an abrasive belt entrained around said drive pulley and said first idler pulley to provide an abrasive surface to finish a tubular member, the improvement comprising:

a second mounting arm supported on said drive housing and including a pivot pulley and a second idler pulley spaced from said pivot pulley; and first and second fixed pulleys rotatably mounted on said drive housing, said abrasive belt being entrained around said drive pulley, said pivot pulley, said first and second idler pulleys and said first and second fixed pulleys to define an endless path of rotation extending along both said first and second mounting arms to abrade opposing sides of said tubular member positioned between said first and second mounting arms.

10. The grinding apparatus of claim 9 wherein said second mounting arm is pivotally mounted for movement about a pivot axis corresponding to an axis of rotation of said pivot pulley to enable said second mounting arm to move relative to said first mounting arm.

11. The grinding apparatus of claim 10 wherein said first mounting arm supports a belt tensioning mechanism operably connected to said first idler pulley for biasing said first idler pulley away from said drive pulley.

12. The grinding apparatus of claim 11 wherein said second mounting arm includes an actuation lever projecting outwardly therefrom and being operable to control the pivoted position of said second mounting arm relative to said first mounting arm.

13. The grinding apparatus of claim 11 further comprising a support housing detachably mounted on said drive housing, said support housing including a support handle projecting outwardly therefrom.

14. The grinding apparatus of claim 13 wherein said support handle is detachable from said support housing, said support housing providing alternative attachment mounts for connecting said support handle thereto.

15. A finishing tool for smoothing outer surfaces of tubular members, comprising:

a drive housing connectable to a source of rotational power;

first and second fixed pulleys rotatably mounted on said drive housing;

a first mounting arm supported on said drive housing and including a drive pulley rotatably driven by said source of rotational power and a first idler pulley spaced from said drive pulley;

a second mounting arm pivotally supported on said drive housing and including a pivot pulley and a second idler pulley spaced from said pivot pulley, said second mounting arm being movable about a pivot axis corresponding to an axis of rotation of said pivot pulley to enable said second mounting arm to move relative to said first mounting arm; and an abrasive belt entrained around said drive pulley, said first and second fixed pulleys, said pivot pulley and said first and second idler pulleys to define an endless path of rotation that extends along said first and second mounting arms to abrade tubular material positioned between said first and second mounting arms.

16. The finishing tool of claim 15 wherein said first mounting arm is positionally fixed on said drive housing.

17. The finishing tool of claim 15 wherein said first mounting arm supports a belt tensioning mechanism operably connected to said first idler pulley to bias said first idler pulley away from said drive pulley.

18. The finishing tool of claim 15 wherein said second mounting arm includes an actuation lever projecting outwardly therefrom and operable to control the pivoted position of said second mounting arm relative to said first mounting arm.

19. The finishing tool of claim 15 further comprising a support housing detachably mounted on said drive housing, said support housing including a support handle projecting outwardly therefrom.

20. The finishing tool of claim 19 wherein said support handle is detachable from said support housing, said support housing providing alternative attachment mounts for connecting said support handle thereto.

* * * * *